US010517388B2

(12) United States Patent
Perez et al.

(10) Patent No.: US 10,517,388 B2
(45) Date of Patent: Dec. 31, 2019

(54) OIL STRIPPING DEVICE

(71) Applicants: Alex Perez, Passaic, NJ (US); Lylybell Mendez, Passaic, NJ (US)

(72) Inventors: Alex Perez, Passaic, NJ (US); Lylybell Mendez, Passaic, NJ (US)

( * ) Notice: Subject to any disclaimer, the term of this patent is extended or adjusted under 35 U.S.C. 154(b) by 133 days.

(21) Appl. No.: 15/921,321

(22) Filed: Mar. 14, 2018

(65) Prior Publication Data

US 2019/0281971 A1 Sep. 19, 2019

(51) Int. Cl.
*A46D 1/00* (2006.01)
*A46B 9/02* (2006.01)

(52) U.S. Cl.
CPC ..... *A46D 1/0261* (2013.01); *A46B 9/023* (2013.01); *A46D 1/0284* (2013.01)

(58) Field of Classification Search
CPC ..... A46D 1/0261; A46D 1/0284; A46B 9/023
USPC ..... 15/207.2
See application file for complete search history.

(56) References Cited

U.S. PATENT DOCUMENTS

D168,913 S 2/1953 Snyder
4,856,541 A * 8/1989 Kellett ..... A45D 19/02 132/110
5,077,914 A * 1/1992 Yamamoto ..... A46B 5/00 132/108
9,486,062 B1 * 11/2016 Piatetsky ..... A46B 11/0013
2008/0105270 A1 * 5/2008 Walters ..... A45D 24/22 132/112
2008/0148504 A1 * 6/2008 Kuo ..... A45D 24/22 15/104.94
2013/0340781 A1 * 12/2013 Liebel ..... A45D 24/30 132/200
2015/0107528 A1 * 4/2015 Moeller ..... A46B 5/0008 119/625
2015/0216292 A1 * 8/2015 Tweel ..... A46B 9/06 15/160
2015/0272313 A1 * 10/2015 Alsalameh ..... A45D 19/02 401/28
2015/0359323 A1 * 12/2015 Clift ..... A01K 13/002 222/1
2018/0116363 A1 * 5/2018 Grez ..... A45D 24/28
2018/0295978 A1 * 10/2018 Kim ..... A46B 9/028
2018/0344020 A1 * 12/2018 Sommer ..... A46B 11/0065

* cited by examiner

*Primary Examiner* — Marc Carlson

(57) ABSTRACT

An oil stripping device for removing oil from hair includes a plate that has a handle is coupled to an end. A pad, which comprises a sorbent and is configured to absorb oil, is coupled to an upper face of the plate. A plurality of bristles is coupled to and extends from the upper face of the plate through the pad. The handle is configured to be grasped in a hand of a user positioning the bristles to brush a strand of hair. Each bristle comprises a wall that is annular so that the bristle is tubular. A plurality of barbs is coupled to and extends from the wall. The barbs are configured to scrape oil from hairs and to direct the oil toward the wall. The oil enters the bristle through set of holes. The bristle directs the oil to the pad, positioning the pad to absorb the oil.

10 Claims, 4 Drawing Sheets

OIL STRIPPING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to stripping devices and more particularly pertains to a new stripping device for removing oil from hair.

BRIEF SUMMARY OF THE INVENTION

An embodiment of the disclosure meets the needs presented above by generally comprising a plate that has a handle is coupled to an end. A pad, which comprises a sorbent and is configured to absorb oil, is coupled to an upper face of the plate. A plurality of bristles is coupled to and extends from the upper face of the plate through the pad. The handle is configured to be grasped in a hand of a user positioning the bristles to brush a strand of hair. Each bristle comprises a wall that is annular so that the bristle is tubular. A plurality of barbs is coupled to and extends from the wall. The barbs are configured to scrape oil from hairs and to direct the oil toward the wall. The oil enters the bristle through set of holes. The bristle directs the oil to the pad, positioning the pad to absorb the oil.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
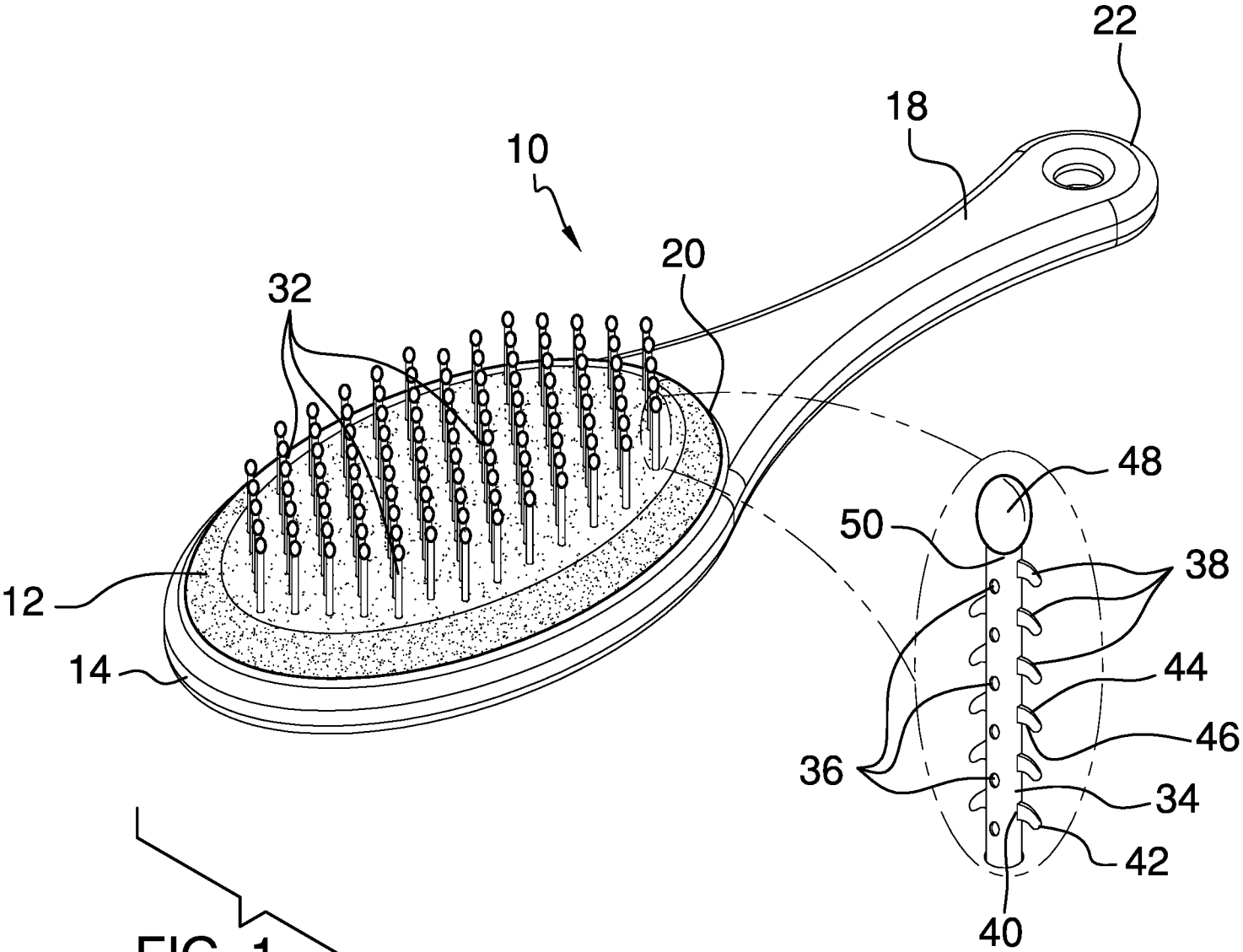
FIG. 1 is an isometric perspective view of an oil stripping device according to an embodiment of the disclosure.

With reference now to the drawings, and in particular to FIGS. 1 through 5 thereof, a new stripping device embodying the principles and concepts of an embodiment of the disclosure and generally designated by the reference numeral 10 will be described.

As best illustrated in FIGS. 1 through 5, the oil stripping device 10 generally comprises a plate 12 that is substantially ovally shaped. A pad 14 is coupled to an upper face 16 of the plate 12, as shown in FIG. 1. The pad 14 comprises a sorbent 18 so that the pad 14 is configured to absorb oil.

A handle 18 is coupled to and extends from an end 20 of the plate 12. The handle 18 is configured to be grasped in a hand of a user. The handle 18 has a terminus 22 distal from the plate 12. The terminus 22 is arcuate.

Figure 2:
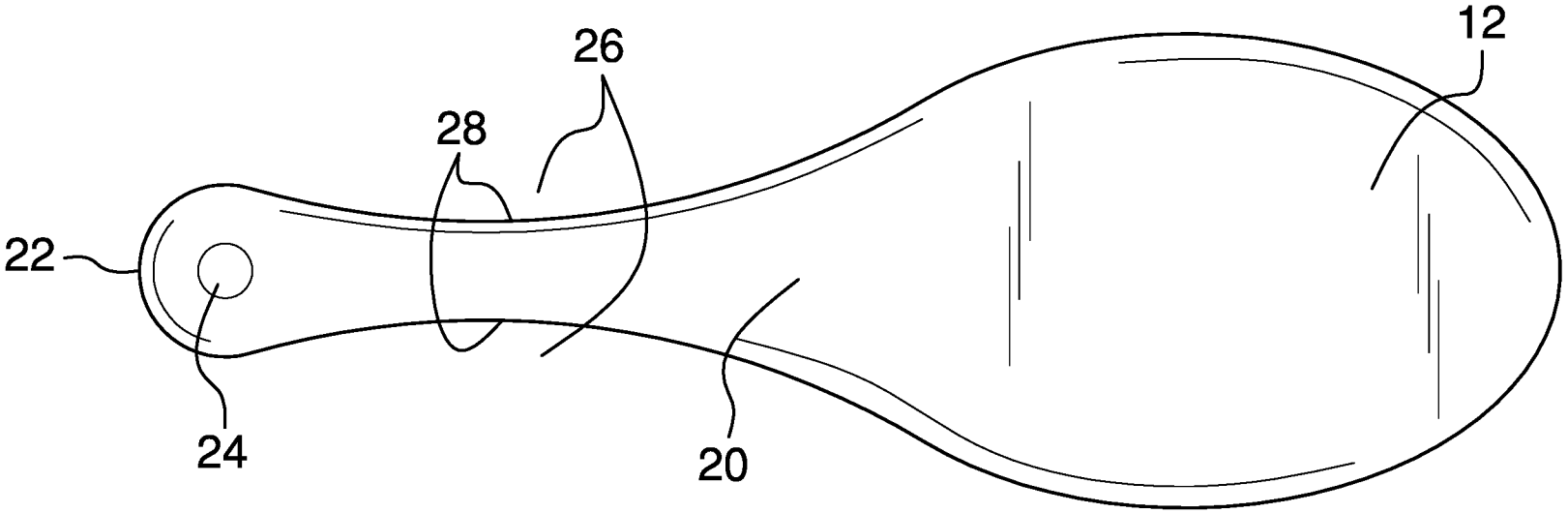
FIG. 2 is a bottom view of an embodiment of the disclosure.
Figure 3:
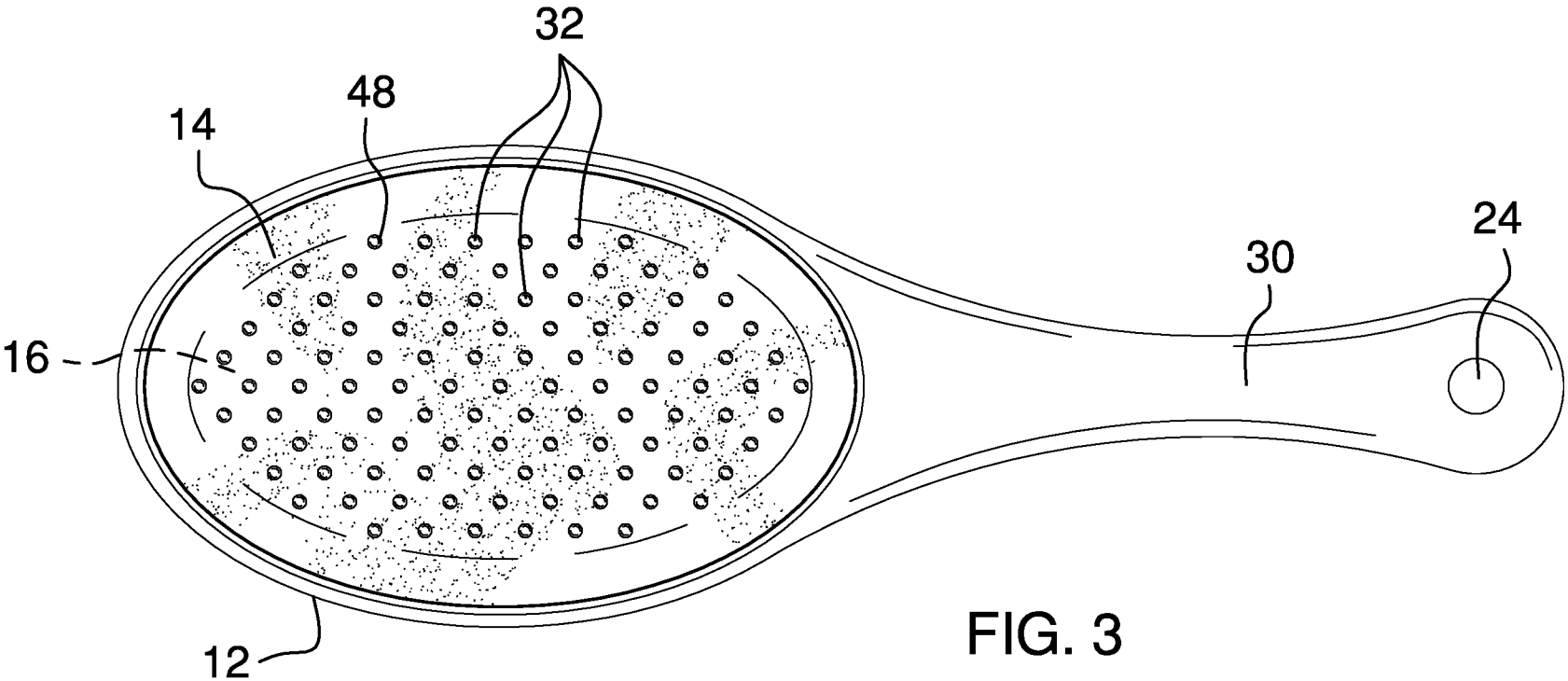
FIG. 3 is a top view of an embodiment of the disclosure.

An aperture 24 is positioned through the handle 18 proximate to the terminus 22, as shown in FIG. 2. The aperture 24 is configured to insert a hook that is coupled to a vertical surface to hang the plate 12.

Each of a pair of recesses 26 extends into a respective opposing edge 28 of the handle 18. The recesses 26 are arcuate. The recesses 26 define a grasp section 30 of the handle 18 that is configured to deter slippage of the hand of the user.

Figure 4:
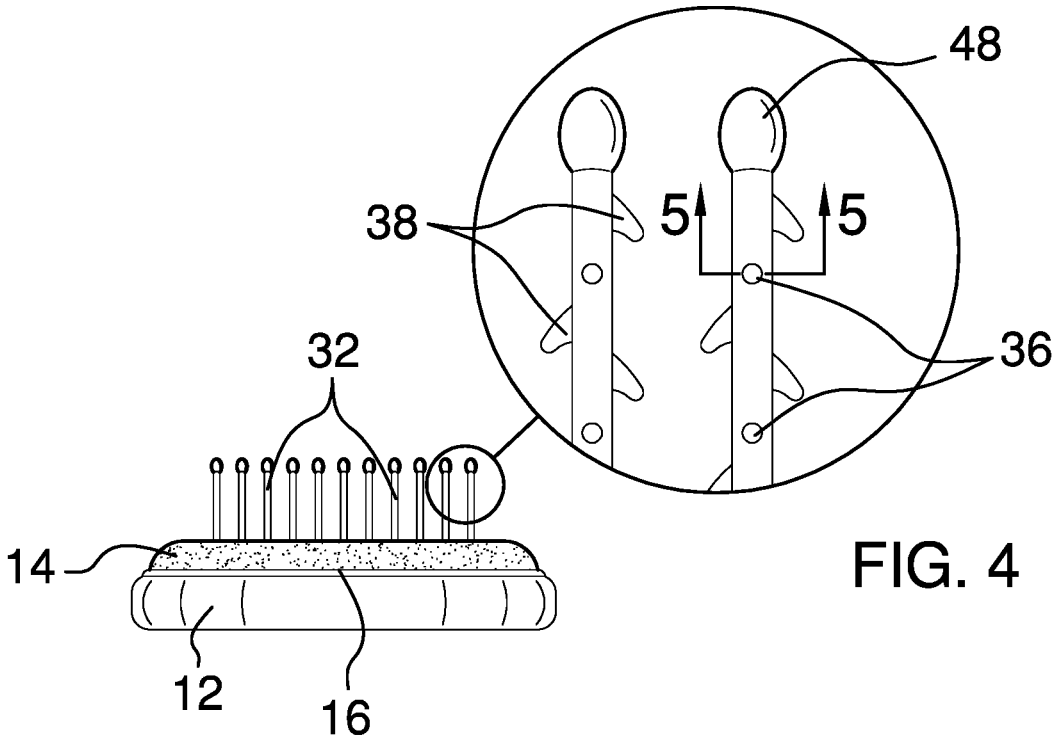
FIG. 4 is an end view of an embodiment of the disclosure.
Figure 5:
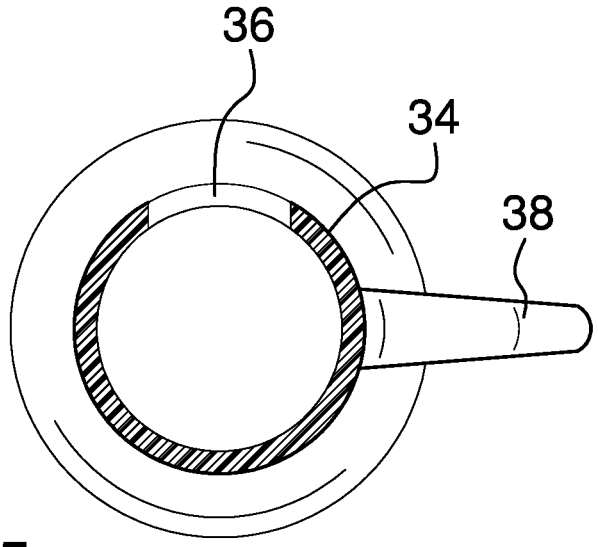
FIG. 5 is a cross-sectional view of an embodiment of the disclosure.

A plurality of bristles 32 is coupled to and extends from the upper face 16 of the plate 12. The bristles 32 extend through the pad 14. The bristles 32 are configured to brush a strand of hair. Each bristle 32 comprises a wall 34. The wall 34 is annular so that the bristle 32 is tubular, as shown in FIG. 5. A set of holes 36 is positioned through the wall 34, as shown in FIG. 4.

Each of a plurality of barbs 38 is coupled to and extends radially from the wall 34. The barbs 38 are configured to scrape oil from the hairs of the strand of hair and to direct the oil toward the wall 34. The oil enters the bristle 32 through the holes 36. The bristle 32 is configured to direct the oil to the pad 14, positioning the pad 14 to absorb the oil.

Each barb 38 comprises a base 40 that is coupled to the wall 34. An apex 42 is positioned distal from the wall 34. The apex 42 is arcuate. A first side 44 extends between the base 40 and the apex 42. A second side 46 extends between the base 40 and the apex 42 so that the barb 38 is substantially triangularly shaped. The first side 44 is dimensionally longer than the second side 46 so that the barb 38 extends transversely from the wall 34 toward the pad 14. The barb 38 is configured to selectively retain the hair adjacent to the wall 34 and the second side 46 to facilitate the scraping of the oil from the hair.

A bulb 48 is coupled to an endpoint 50 of the wall 34 distal from the plate 12. The bulb is configured to facilitate insertion of the bristle 32 between hairs of the strand of hair.

In use, the handle 18 is configured to be grasped in a hand of the user, positioning the user for passing the bristles 32 through the strand of hair to brush the strand of hair. The barbs 38 are configured to scrape the oil from the hairs of the strand of hair and to direct the oil toward the wall 34. The oil enters the bristle 32 through the holes 36. The bristles 32 are configured to direct the oil to the pad 14, positioning the pad 14 to absorb the oil.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An oil stripping device comprising:
- a plate;
- a pad coupled to an upper face of said plate, said pad comprising a sorbent wherein said pad is configured for absorbing oil;
- a handle coupled to and extending from an end of said plate, wherein said handle is positioned on said plate such that said handle is configured for grasping in a hand of a user;
- a plurality of bristles coupled to and extending from said upper face of said plate, said bristles extending through said pad such that said bristles are configured for brushing a strand of hair, each said bristle comprising:
  - a wall, said wall being annular such that said bristle is tubular,
  - a set of holes positioned through said wall,
  - a plurality of barbs, each said barb being coupled to and extending radially from said wall; and
- wherein said barbs are positioned on said wall such that said barbs are configured for scraping oil from hairs of the strand of hair and for directing the oil toward said wall such that the oil enters said bristle through said holes, wherein said bristle is configured for directing the oil to said pad positioning said pad for absorbing the oil.

2. The device of claim 1, further including said plate being substantially ovally shaped.

3. The device of claim 1, further including said handle having a terminus distal from said plate, said terminus being arcuate.

4. The device of claim 3, further including an aperture positioned through said handle proximate to said terminus wherein said aperture is configured for inserting a hook coupled to a vertical surface for hanging said plate.

5. The device of claim 1, further including a pair of recesses, said recesses being arcuate, each said recess extending into a respective opposing edge of said handle defining a grasp section of said handle configured for deterring slippage of the hand of the user.

6. The device of claim 1, further including each said barb comprising:
- a base coupled to said wall;
- an apex positioned distal from said wall;
- a first side extending between said base and said apex; and
- a second side extending between said base and said apex such that said barb is substantially triangularly shaped.

7. The device of claim 6, further including said apex being arcuate.

8. The device of claim 6, further including said first side being dimensionally longer than said second side such that said barb extends transversely from said wall toward said pad such that said barb is configured for selectively retaining the hair adjacent to said wall and said second side for facilitating the scraping of the oil from the hair.

9. The device of claim 1, further including a bulb coupled to an endpoint of said wall distal from said plate wherein said bulb is configured for facilitating insertion of said bristle between hairs of the strand of hair.

10. An oil stripping device comprising:
- a plate, said plate being substantially ovally shaped;
- a pad coupled to an upper face of said plate, said pad comprising a sorbent wherein said pad is configured for absorbing oil;
- a handle coupled to and extending from an end of said plate, wherein said handle is positioned on said plate such that said handle is configured for grasping in a hand of a user, said handle having a terminus distal from said plate, said terminus being arcuate;
- an aperture positioned through said handle proximate to said terminus wherein said aperture is configured for inserting a hook coupled to a vertical surface for hanging said plate;
- a pair of recesses, said recesses being arcuate, each said recess extending into a respective opposing edge of said handle defining a grasp section of said handle configured for deterring slippage of the hand of the user;
- a plurality of bristles coupled to and extending from said upper face of said plate, said bristles extending through said pad such that said bristles are configured for brushing a strand of hair, each said bristle comprising:
  - a wall, said wall being annular such that said bristle is tubular,
  - a set of holes positioned through said wall,
  - a plurality of barbs, each said barb being coupled to and extending radially from said wall, wherein said barbs are positioned on said wall such that said barbs are configured for scraping oil from the hairs of the strand of hair and for directing the oil toward said wall such that the oil enters said bristle through said holes, wherein said bristle is configured for directing the oil to said pad positioning said pad for absorbing the oil, each said barb comprising:
    - a base coupled to said wall, an apex positioned distal from said wall, said apex being arcuate, a first side extending between said base and said apex, a second side extending between said base and said apex such that said barb is substantially triangularly shaped, said first side being dimensionally longer than said second side such that said barb extends transversely from said wall toward said pad such that said barb is configured for selectively retaining the hair adjacent to said wall and said second side for facilitating the scraping of the oil from the hair, and a bulb coupled to an endpoint of said wall distal from said plate wherein said bulb is configured for facilitating insertion of said bristle between hairs of the strand of hair; and wherein said handle is positioned on said plate such that said handle is configured for grasping in a hand of the user positioning for passing said bristles through the strand of hair for brushing the strand of hair, wherein said barbs are positioned on said wall such that said barbs are configured for scraping the oil from the hairs of the strand of hair and for directing the oil toward said wall such that the oil enters said bristle through said holes, wherein said bristles are configured for directing the oil to said pad positioning said pad for absorbing the oil.

* * * * *